United States Patent [19]

Lenkeit et al.

[11] Patent Number: 5,058,504

[45] Date of Patent: Oct. 22, 1991

[54] APPARATUS FOR CONTROLLING THE LATERAL DISPOSITION OF A TRAVELING SERVICE UNIT OF A TEXTILE MACHINE

[75] Inventors: Uwe Lenkeit, Göppingen-Faurndau; Hans-Peter Weeger, Hattenhofen, both of Fed. Rep. of Germany

[73] Assignee: Zinser Textilmaschinen GmbH, Ebersbach/Fils, Fed. Rep. of Germany

[21] Appl. No.: 498,228

[22] Filed: Mar. 23, 1990

[30] Foreign Application Priority Data

Mar. 23, 1989 [DE] Fed. Rep. of Germany ..... 3909724

[51] Int. Cl.[5] ..... D01H 9/10

[52] U.S. Cl. ..... 104/243; 104/245; 105/164; 57/268; 180/41

[58] Field of Search ..... 105/217, 199.1, 164, 105/199.2, 179, 216; 104/88, 106, 243, 244, 245, 247; 57/264, 268, 269, 270, 271, 272; 180/41

[56] References Cited

U.S. PATENT DOCUMENTS

| | | | |
|---|---|---|---|
| 3,707,926 | 1/1973 | Elley | 104/243 |
| 4,081,949 | 4/1978 | Keller et al. | 57/268 |
| 4,843,810 | 7/1989 | Kabilka et al. | 104/243 |
| 4,843,972 | 7/1989 | Kabilka et al. | 104/284 |

FOREIGN PATENT DOCUMENTS

| | | |
|---|---|---|
| 1213770 | 3/1966 | Fed. Rep. of Germany . |
| 1280107 | 10/1968 | Fed. Rep. of Germany . |
| 2454900 | 5/1976 | Fed. Rep. of Germany . |
| 3634474 | 4/1988 | Fed. Rep. of Germany . |
| 3641480 | 6/1988 | Fed. Rep. of Germany . |
| 3641481 | 6/1988 | Fed. Rep. of Germany . |
| 60-67371 | 4/1985 | Japan . |
| 60-71725 | 4/1985 | Japan . |

*Primary Examiner*—Robert J. Oberleitner
*Assistant Examiner*—Mark T. Le
*Attorney, Agent, or Firm*—Shefte, Pinckney & Sawyer

[57] ABSTRACT

An apparatus for controlling the lateral disposition of a guide roller of a traveling service unit on a textile machine is provided. The apparatus includes a first support wheel rotatably mounted on the traveling service unit and an adjustable wheel assembly. The adjustable wheel assembly includes a second support wheel laterally spaced from the first support wheel, a device for rotatably mounting the second wheel to the traveling service unit and a device for selectively adjusting the vertical displacement of the second wheel relative to the traveling service unit to maintain the guide roller at a predetermined disposition relative to a guide surface of the textile machine. The device for selectively adjusting the vertical displacement of the second wheel includes, in one aspect of the invention, a cylinder and piston assembly and, in another aspect of the invention, a pair of bell cranks interconnected to one another by a cylinder and piston assembly.

12 Claims, 2 Drawing Sheets

APPARATUS FOR CONTROLLING THE LATERAL DISPOSITION OF A TRAVELING SERVICE UNIT OF A TEXTILE MACHINE

BACKGROUND OF THE INVENTION

The present invention relates to an apparatus for controlling the positioning of a traveling service unit of a textile machine.

One known type of traveling service unit for individually servicing the stations of a textile machine is configured to move longitudinally along the side of the textile machine. To this end, the textile machine is provided with a longitudinally extending, laterally facing guide surface and the traveling service unit is provided with a guide element for travel along the guide surface in a longitudinal direction to maintain the lateral position of the traveling service unit relative to the textile machine. The traveling service unit is typically provided with a plurality of roller wheels for rolling travel along the floor adjacent the textile machine.

Due to unevenness in the floor along which the traveling service unit travels, the guide element supported on the traveling service unit tends to tilt toward and away from the guide surface which can result in the transmission of relatively significant lateral forces to the guide surface on the textile machine as the traveling service unit traverses the uneven portions of the floor. The frame of the textile machine must accordingly be appropriately reenforced to accommodate such occasional relatively significant lateral forces. Accordingly, the need exists for an apparatus which controls the lateral pressure of the guide element on a traveling service unit against the guide surface of the textile machine to reduce the lateral forces transmitted to the textile machine.

SUMMARY OF THE INVENTION

The present invention provides an apparatus for controlling the lateral pressure of the guide element mounted on the traveling service unit against the guide surface on a textile machine to reduce the transmission of lateral forces to the textile machine.

Briefly described, the present invention provides an apparatus for controlling the lateral disposition pressure of the guide roller against the guide surface for a textile machine of the type having a number of stations arranged in series with one another in a longitudinal direction, a longitudinally extending, laterally facing guide surface and a traveling service unit movable longitudinally along the textile machine for individually servicing the stations, the traveling service unit including a guide roller supported thereon for travel along the guide surface in a longitudinal direction.

The apparatus includes a first support wheel rotatably mounted on the traveling service unit for rolling travel on the floor along a path to support the traveling service unit thereon and an adjustable wheel assembly including a second support wheel laterally spaced from the first support wheel, means for rotatably mounting the second wheel to the traveling service unit for rolling travel on the floor along a path to support the traveling service unit thereon and means for selectively adjusting the vertical displacement of the second wheel relative to the traveling service unit to maintain the guide roller at a predetermined disposition relative to the guide surface, whereby the traveling service unit is maintained in a desired operating position laterally of the textile machine.

According to one aspect of the present invention, the second support wheel is spaced laterally further from the textile machine than the first support wheel. Preferably, a third support wheel is rotatably mounted on the traveling service unit for rolling travel along a path generally coincident with the path of travel of the second support wheel to support the traveling service unit thereon and means for selectively adjusting the vertical displacement of the third wheel relative to the traveling service unit.

According to another aspect of the present invention, a third support wheel is rotatably mounted on the traveling service unit for rolling travel on the floor along a path generally coincident with the path of the first floor wheel to support the traveling service unit thereon. Preferably, the third support wheel is laterally spaced from the first wheel, and means for rotatably mounting the third wheel on the traveling service unit at a longitudinal spacing from the second wheel and the selectively adjusting means includes means for selectively synchronously adjusting the vertical displacements of the second and third wheels relative to the traveling service unit is provided.

According to a further aspect of the present invention, the means for rotatably mounting the second wheel and the means for rotatably mounting the third wheel each include a bell crank means pivotally mounted to the traveling service unit and the selectively adjusting means includes a cylinder and piston assembly, the closed end of the cylinder being connected to the bell crank means of one of the second and third wheels and the free end of the piston being connected to the bell crank means of the other of the second and third wheels, the piston being selectively extendable from, and retractable into, the cylinder for effecting synchronous pivoting of the bell crank means to selectively adjust the vertical displacement of the second and third wheels relative to the traveling service unit.

Preferably, the means for rotatably mounting the second wheel and the means for rotatably mounting the third wheel each include a cylinder and piston assembly, each respective second and third wheel being rotatably connected to one end of the cylinder and piston assembly, and the selectively adjusting means includes a source of pressurized fluid, means commonly connecting the cylinder and piston assemblies to the pressurized fluid source and means for controlling the supply of pressurized fluid from the pressurized fluid source to the cylinder and piston assemblies to selectively synchronously adjust the vertical displacements of the second and third wheels relative to the traveling service unit. The selectively adjusting means may include means for electronically adjusting the vertical displacement of the laterally spaced wheel relative to the traveling service unit.

In a preferred embodiment, means for maintaining the second wheel at a predetermined vertical displacement relative to the traveling service unit during non-engagement of the guide roller with the guide surface of a textile machine is provided.

In a further preferred embodiment, the means for rotatably mounting the second wheel includes a rod rotatably supported on the traveling service unit for axial movement relative thereto, the second wheel being mounted to one end of the rod, and the selectively adjusting means includes a worm gear assembly including a drive worm, a worm gear threaded externally for driving engagement by the drive worm and having a throughbore with an internal worm thread, and an inner worm shaft coaxially movably mounted on the rod and connected thereto by means for resiliently maintaining the inner worm shaft and the second wheel at a predetermined spacing from one another relative to the axis of the rod, the worm gear being rotatably supported on the traveling service unit and the drive worm being operable to rotate the worm gear to effect relative axial movement between the inner worm shaft and the rod, whereby the traveling service unit is vertically displaced relative to the second wheel in correspondence with the relative axial movement between the inner worm shaft and the rod.

DETAILED DESCRIPTIONS OF THE PREFERRED EMBODIMENTS

Figure 1:
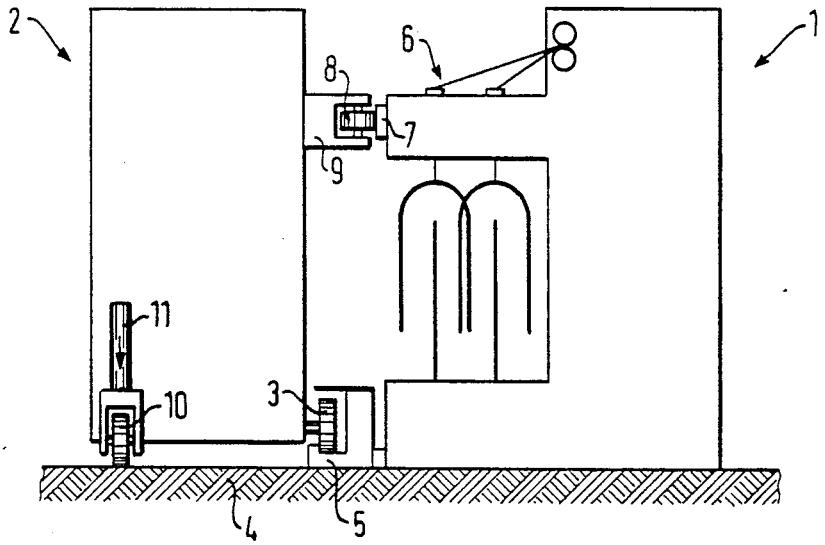
FIG. 1 is a schematic side view of a textile machine and a traveling service unit movable longitudinally along the textile machine for servicing individual stations thereof and showing one embodiment of the lateral pressure controlling apparatus of the present invention.
Figure 2:
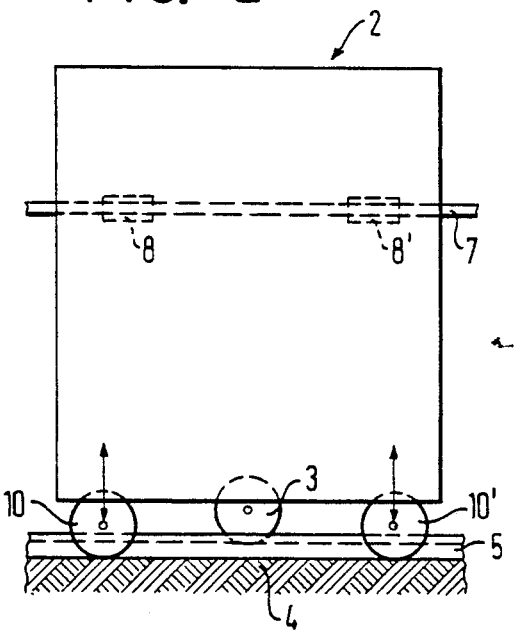
FIG. 2 is a schematic front elevational view of the embodiment of the lateral pressure controlling apparatus shown in FIG. 1.

In FIGS. 1 and 2, one embodiment of the lateral pressure controlling apparatus of the present invention is illustrated. A textile machine, such as, for example, a spinning machine 1, includes a plurality of stations arranged in series with one another in a longitudinal direction. A traveling service unit 2 is movable longitudinally along the spinning machine 1 to individually service the stations thereof. The spinning machine 1 includes a longitudinally extending, laterally facing guide surface 7 mounted on a machine frame 6 and a longitudinally extending, upwardly facing U-shaped guide beam 5 mounted on the floor 4 along the spinning machine 1.

The traveling service unit 2 includes a pair of longitudinally spaced guide elements 8,8', in the form of conventional follower rollers rotatably supported by a conventional mounting means 9 for rotation about vertical axes in following engagement with the guide surface 7. Additionally, the traveling service unit 2 includes a first support wheel 3 rotatably mounted thereto about a horizontal axis for rolling travel in the floor guide beam 5 of the spinning machine 1 to maintain the traveling service unit in operating disposition laterally with respect to the machine.

The traveling service unit 2 additionally includes an adjustable wheel assembly including a second wheel 10 laterally spaced from the first support wheel 3, means for rotatably mounting this first laterally spaced second wheel 10 to the traveling service unit for rolling travel of the wheel on the floor 4 along a path to support the traveling service unit 2 thereon and means 11 for selectively adjusting the vertical displacement of the second wheel 10 relative to the traveling service unit. The selectively adjusting means 11, which can be a pneumatic cylinder and piston assembly, adjusts the vertical displacement of the second wheel 10 relative to the traveling service unit 2 to maintain the traveling service unit in a stable position regardless of unevenness in the floor so as to dispose the guide rollers 8,8' at a predetermined position relative to the guide surface 7, thereby also maintaining the traveling service unit in a desired operating position laterally of the spinning machine 1.

As seen in FIG. 2, the traveling service unit 2 is provided with a third wheel 10' laterally spaced from the first support wheel 3 and longitudinally spaced from the second wheel 10. The first support wheel 3 is generally longitudinally intermediately spaced between the second wheel 10 and the third wheel 10'. Accordingly, the traveling service unit is supported in a three-point contact manner on the floor 4 during its travel longitudinally along the spinning machine 1.

The selectively adjusting means 11 is operable to selectively vertically move the wheel mounting means and the respective wheel 10,10'. As can be understood, the lateral pressure of the guide rollers 8,8' on the guide surface 7 increases correspondingly with increasing vertical displacement of the second and third wheels 10,10' and the traveling service unit 2 relative to one another. Conversely, the lateral pressure of the guide rollers 8,8' on the guide surface 7 decreases correspondingly with decreasing vertical displacement of the wheels 10,10' and the traveling service unit 2 relative to one another. The selectively adjusting means 11 can include appropriate electronic, pneumatic or mechanical means for vertically adjusting the wheels 10,10'.

Figure 3:
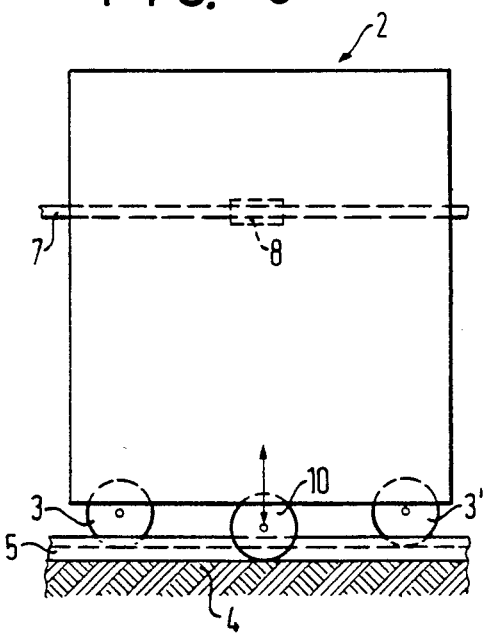
FIG. 3 is a schematic front elevational view of another embodiment of the lateral pressure controlling apparatus of the present invention.

In FIG. 3, another embodiment of the lateral pressure controlling apparatus of the present invention is illustrated. A traveling service unit 2 travels longitudinally along the spinning machine 1 in the same manner as discussed with respect to FIGS. 1 and 2. The traveling service unit 2 includes a first support wheel 3 rotatably mounted thereto for rolling travel along the floor 4 and a second support wheel 3' rotatably mounted thereto for rolling travel along the floor 4. The support wheels 3,3' are aligned in a longitudinal spacing relative to the spinning machine 1 and are disposed on the guide beam 5 for rolling travel therealong. A second wheel 10 is rotatably mounted to the traveling service unit 2 by a conventional wheel mounting means at a lateral spacing from the support wheels 3,3'. A means for selectively adjusting the vertical displacement of the second wheel 10 relative to the service unit 2 is connected to the conventional wheel mounting means and is operable to dispose a single guide roller 8 at a predetermined position relative to the guide surface 7 on the spinning machine to maintain the roller at a predetermined lateral pressure against the guide surface 7, which also maintains the traveling service unit in a desired operating position laterally of the spinning machine 1.

Figure 4:
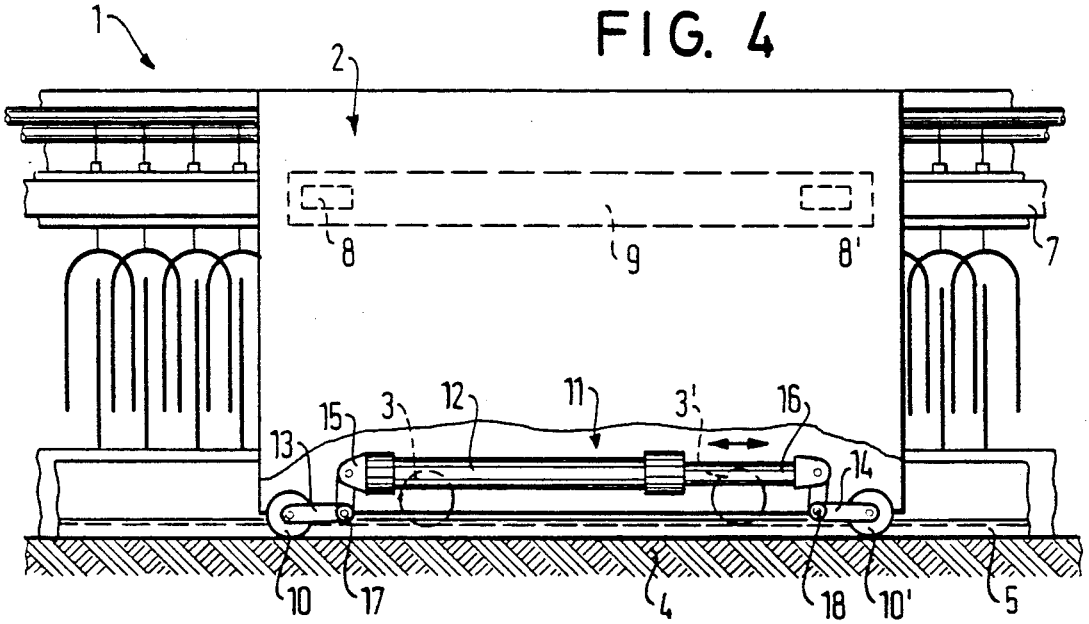
FIG. 4 is a schematic front elevational view, in partial vertical section, of a further embodiment of the lateral pressure controlling apparatus of the present invention.

In FIG. 4, a further embodiment of the lateral pressure controlling apparatus of the present invention is illustrated. A traveling service unit 2 is movable longitudinally along the spinning machine 1 to individually service the stations thereof. The traveling service unit 2 includes a pair of aligned, longitudinally spaced guide rollers 8,8' rotatably mounted thereto by a mounting means 9. The traveling service unit 2 additionally includes a pair of aligned, longitudinally spaced support wheels 3,3' for rolling travel along the floor guide beam 5 of the spinning machine 1. The traveling service unit 2 further includes a pair of wheels 10,10' laterally spaced from the support wheels 3,3'.

Each wheel 10,10' is rotatably mounted to the free end of one arm of a bell crank 13,14, respectively. Each bell crank 13,14 is pivotally connected to the traveling service unit 2 by a pivot pin 17,18, respectively. The free ends of the respective other arms bell cranks 13,14 are interconnected to one another by a means 11 for selectively adjusting the vertical displacement of the laterally spaced wheels 10,10' relative to the traveling service unit 2. The selectively adjusting means 11 includes a cylinder and piston assembly 12 having a cylinder 3 pivotally connected at its closed end 15 to the free end of the other arm of the bell crank 13 and a piston 16 selectively extendable from, and retractable into, the cylinder 3 and connected at its free end to the free end of the other arm of the bell crank 14. To control the lateral pressure of the guide rollers 8,8' on the guide surface 7 of the spinning machine 1, the selectively adjusting means 11 is operated to adjust the vertical displacement of the laterally spaced wheels 10,10' relative to the traveling service unit 2. To increase the lateral pressure of the guide rollers 8,8' on the guide surface 7, the piston 16 is extended from the cylinder 3, thereby effecting pivoting movement of the bell crank 13 in a counterclockwise direction about the pivot pin 17, as viewed in FIG. 4, and clockwise pivoting of the bell crank 14 about the pivot pin 18. The respective pivoting of the bell cranks 13,14 increases the vertical displacement of the laterally spaced wheels 10,10' relative to the traveling service unit 2 and correspondingly increases the lateral pressure of the guide rollers 8,8' against the guide surface 7. To decrease the lateral pressure of the guide rollers 8,8' on the guide surface 7, the piston 16 is retracted into the cylinder 3 to effect pivoting of the bell crank 13 in a clockwise direction about the pivot pin 17 and pivoting of the bell crank 14 in a counterclockwise direction about the pivot pin 18. The operation of the selectively adjusting means 11 can be controlled by a control means (not shown) and appropriate conventional sensing means such as, for example, a pressure limit sensor, can be provided to monitor the lateral pressure of the guide rollers 8,8' on the guide surface 7.

Figure 5:
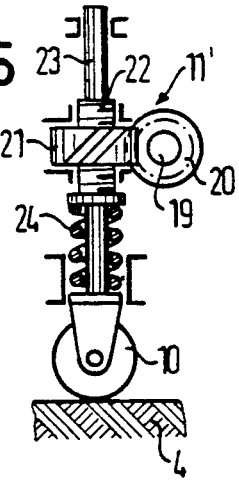
FIG. 5 is an enlarged elevational view of one type of vertical displacement means of the lateral pressure controlling apparatus of the present invention.

In FIG. 5, a means 11' for selectively adjusting the vertical displacement of a laterally spaced wheel 10 relative to a traveling service unit (not shown) is illustrated. The laterally spaced wheel 10 is rotatably mounted to the free end of a vertical rod 23 which is movably supported on the traveling service unit by conventional support means for vertical movement of the shaft 23 along its axis. A worm 22 includes an axial throughbore in which the vertical rod 23 is slidably received for permitting the vertical rod 23 to move axially relative to the worm 22. A worm gear 21 is rotatably supported on the traveling service unit and includes a threaded bore compatibly configured with the worm 22 for meshing engagement therewith and a plurality of outer circumferential worm gear teeth. A drive worm 20 is rotatably mounted to the traveling service unit for rotation about an axis 19 and is compatibly configured with the outer worm gear teeth of the worm gear 21 for meshing engagement therewith. A coil spring 24 is mounted between the bottom of the worm 22 and the free end portion of the vertical rod 23 for resiliently maintaining the wheel 10 at a predetermined vertical spacing from the worm 22.

In operation, the drive worm 20 is rotated to effect rotation of the worm gear 21 The rotation of the worm gear 21 causes the inner worm shaft 22 to move up or down in the worm gear 21 to selectively upwardly or downwardly move the traveling service unit on the wheel 10 to tilt the traveling service unit and thereby adjust the pressure of the roller against the guide surface.

Figure 6:
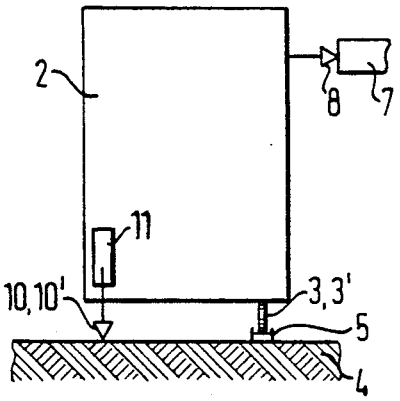
FIG. 6 is a schematic side view of yet another embodiment of the lateral pressure controlling apparatus of the present invention.
Figure 7:
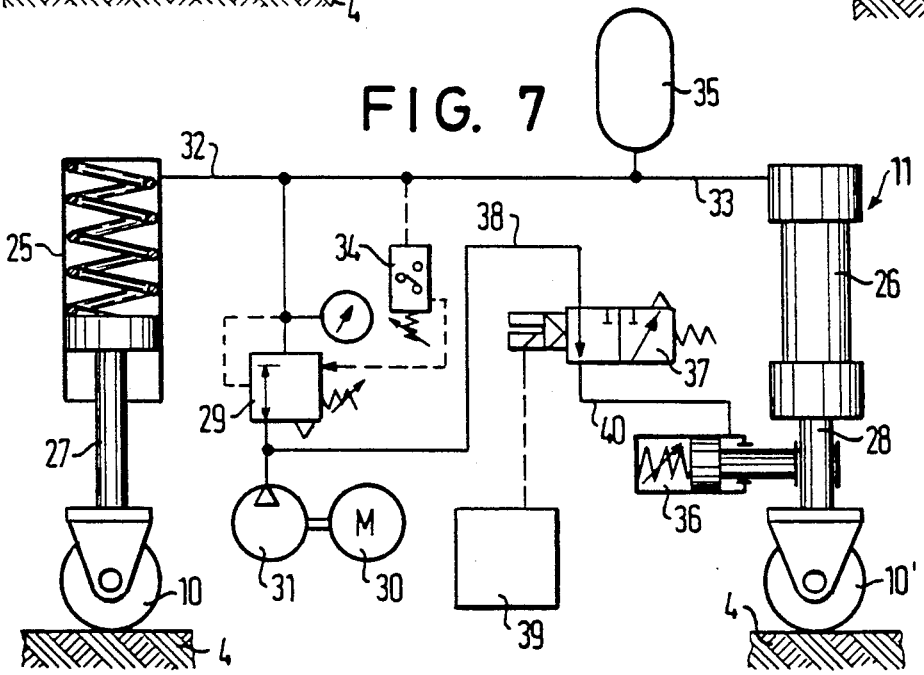
FIG. 7 is a diagrammatic view of another type of the vertical displacement means of the lateral pressure controlling apparatus of the present invention.

In FIGS. 6 and 7, yet another embodiment of the lateral pressure controlling apparatus of the present invention is illustrated. A traveling service unit 2 includes a guide roller 8 for travel along the guide surface 7 of a spinning machine and a pair of aligned, longitudinally spaced support wheels 3,3' support the traveling service unit along a guided path on a floor beam 5 mounted to the floor 4 on which the spinning machine is mounted. A pair of wheels 10,10' are laterally spaced from the support wheels 3,3' and aligned with one another. The laterally spaced wheels 10,10' are longitudinally spaced from one another and are commonly connected to each other by means 11 for selectively adjusting the vertical displacement of the laterally spaced wheels relative to the traveling service unit.

As best seen in FIG. 7, the selectively adjusting means 11 includes a pair of cylinder and piston assemblies each for mounting a respective one of the laterally spaced wheels 10,10' to the traveling service unit 2. Each cylinder 25,26 of the cylinder and piston assemblies includes a coil spring for biasing a piston 27,28, respectively, outwardly with respect to the cylinder. The laterally spaced wheels 10,10' are mounted to the free ends of the pistons 27,28, respectively. Conduits 32,33 connect the cylinders 25,26, respectively, to a common conduit which is connected to a pressure regulating valve 29. The pressure regulating valve 29 is operatively connected to a conventional pressure sensing means 34 which is operatively connected to the common conduit.

A conventional source of pressurized fluid 31, driven by a motor 30, is connected via a supply conduit to the pressure regulating valve 29. A valve 37 is connected via a conduit 38 to the supply conduit between the pressurized fluid source 31 and the pressure regulating valve 29. A cylinder and piston assembly 36 is fixedly mounted to the traveling service unit 2 and the cylinder thereof is connected via a conduit 40 to the valve 37. The free end of the piston of the cylinder and piston assembly 36 is selectively extendable from the cylinder of the cylinder and piston assembly to apply a force against the piston 28 transverse to the axis thereof. An opposing member cooperates with the piston of the cylinder and piston assembly 36 to effect compressive gripping of the piston 28 upon extension of the piston from the cylinder and piston assembly 36. A conventional control unit is operatively connected to the valve 37. A pressure fluid relief reservoir 35 is communicated with the conduit 33.

The selectively adjusting means 11 is operated as follows to vertically displace the laterally spaced wheels 10,10' relative to the traveling service unit 2. To increase the vertical spacing between the laterally spaced wheels 10,10' and the traveling service unit 2, the pressure regulating valve 29 is opened to permit passage of pressurized fluid from the pressurized fluid source 31 through the conduits 32,33 to the cylinders 25,26, respectively. The pressurized fluid acts against the pistons 27,28 to extend the pistons relative to their respective cylinders 25,26. When the pressure of the pressurized fluid within the cylinders 25,26 reaches a predetermined level such as, for example, 4 bar, the pressure sensor 34 signals the pressure regulating valve 29 to close to prevent further supply of pressurized fluid to the cylinders 25,26. The pressure fluid relief reservoir 35 thereafter acts in conventional manner to temporarily store pressurized fluid in response to momentary travel of the pistons 27,28 into their respective cylinders 25,26 due to the travel of the laterally spaced wheels 10,10' over uneven surfaces in the floor 4.

In the event that the traveling service unit 2 travels between spaced spinning machines so that its guide roller 8 moves out of engagement with the guide surface 7 of the spinning machine which the traveling service unit 2 is clearing, the control unit 39 controls the valve 37 to open to permit passage of pressurized fluid from the pressurized fluid source 31 through the conduits 38,40 to the cylinder and piston assembly 36. The introduction of pressurized fluid to the cylinder and piston assembly 36 effects extension of the piston thereof to compressively engage to the piston 28 between the piston and the opposing member, thereby fixedly securing the piston 28 in a fixed disposition relative to the cylinder 26. When the guide roller 8 engages the guide surface 7 of the next spinning machine, the control unit 39 actuates the valve 37 to close to prevent further introduction of pressurized fluids to the cylinder and piston assembly 36 and, in response thereto, the cylinder and piston assembly 36 releases the piston 28 for further axial movement relative to the cylinder 26 away from the piston 28.

The present invention thus provides a lateral pressure controlling apparatus for controlling the lateral force of a traveling service unit against a textile machine during travel of the traveling service unit along the textile machine. Accordingly, additional reinforcement of the frame of the textile machine can be minimized.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of a type having a number of stations arranged in series with one another in a longitudinal direction, a longitudinally extending, laterally facing guide surface and a traveling service unit movable longitudinally along the textile machine at a lateral spacing therefrom for individually servicing the stations, the traveling service unit including a vertical axis guide roller supported thereon for travel along the guide surface in a longitudinal direction, an apparatus for controlling lateral disposition pressure of the guide roller against the guide surface, comprising:

a first support wheel rotatably mounted on the traveling service unit for rolling travel on a floor along a path to support the traveling service unit thereon, said first support wheel being at a predetermined vertical displacement relative to the traveling service unit; and an adjustable wheel assembly including a second support wheel laterally spaced from said first support wheel, means for rotatably mounting said second wheel to the traveling service unit at a selected vertical displacement relative thereto for rolling travel on the floor along a path to support the traveling service unit thereon, the lateral disposition pressure of the guide roller against the guide surface varying in proportion to the ratio of the vertical displacements of said first and second support wheels to one another, and means for selectively adjusting the vertical displacement of said second support wheel relative to the traveling service unit and relative to said first support wheel to achieve a selected vertical displacement ratio at which the guide roller is maintained at a predetermined lateral disposition pressure against the guide surface, whereby the traveling service unit is maintained in a desired operating position laterally of the textile machine.

2. In a textile machine, the apparatus according to claim 1 and characterized further in that said second support wheel is spaced laterally further from the textile machine than said first support wheel.

3. In a textile machine, the apparatus according to claim 1 and characterized further by a third support wheel rotatably mounted on the traveling service unit for rolling travel along a path generally coincident with the path of travel of said second support wheel to support the traveling service unit thereon and means for selectively adjusting vertical displacement of said third wheel relative to the traveling service unit.

4. In a textile machine, the apparatus according to claim 1 and characterized further by a third support wheel rotatably mounted on the traveling service unit for rolling travel on the floor along a path generally coincident with said path of said first floor wheel to support the traveling service unit thereon.

5. In a textile machine, the apparatus according to claim 1 and characterized further by a third support wheel laterally spaced from said first wheel, means for rotatably mounting said third wheel on the traveling service unit at a longitudinal spacing from said second wheel and said selectively adjusting means includes means for selectively synchronously adjusting vertical displacements of said second and third wheels relative to the traveling service unit.

6. In a textile machine, the apparatus according to claim 5 and characterized further in that said means for rotatably mounting said second wheel and said means for rotatably mounting said third wheel each include a bell crank means pivotally mounted to the traveling service unit and said selectively adjusting means includes a cylinder and piston assembly, a closed end of said cylinder being connected to said bell crank means of one of said second and third wheels and a free end of said piston being connected to said bell crank means of the other of said second and third wheels, said piston being selectively extendable from, and retractable into, said cylinder for effecting synchronous pivoting of said bell crank means to selectively adjust the vertical displacement of said second and third wheels relative to the traveling service unit.

7. In a textile machine, the apparatus according to claim 5 and characterized further in that said means for rotatably mounting said second wheel and said means for rotatably mounting said third wheel each include a cylinder and piston assembly, each of the respective second wheel and third wheel being rotatably connected to one end of the cylinder and piston assembly, and said selectively adjusting means includes a source of pressurized fluid, means commonly connecting said cylinder and piston assemblies to said pressurized fluid source and means for controlling a supply of pressurized fluid from said pressurized fluid source to said cylinder and piston assemblies to selectively synchronously adjust the vertical displacements of said second and third wheels relative to the traveling service unit.

8. In a textile machine, the apparatus according to claim 1 and characterized further in that said selectively adjusting means includes means for electronically adjusting the vertical displacement of said second support wheel relative to the traveling service unit.

9. In a textile machine, the apparatus according to claim 8 and characterized further in that said selectively adjusting means includes means for controlling said electronically adjusting means.

10. In a textile machine, the apparatus according to claim 1 and characterized further by means for maintaining said second wheel at a predetermined vertical displacement relative to the traveling service unit during non-engagement of the guide roller with the guide surface of a textile machine.

11. In a textile machine, the apparatus according to claim 7 and characterized further by reservoir means, connected to said pressurized fluid source, for selectively storing pressurized fluid.

12. In a textile machine, the apparatus according to claim 1 and characterized further in that said means for rotatably mounting said second wheel includes a rod rotatably supported on the traveling service unit for axial movement relative thereto, said second wheel being mounted to one end of said rod, and said selectively adjusting means includes a worm gear assembly including a drive worm, a worm gear threaded externally for driving engagement by said drive worm and having a throughbore with an internal worm thread, and an inner worm shaft coaxially movably mounted on said rod and connected thereto by means for resiliently maintaining said inner worm shaft and said second wheel at a predetermined spacing from one another relative to the axis of said rod, said worm gear being rotatably supported on the traveling service unit and said drive worm being operable to rotate said worm gear to effect relative axial movement between said inner worm shaft and said rod, whereby the traveling service unit is vertically displaced relative to said second wheel in correspondence with said relative axial movement between said inner worm shaft and said rod.

* * * * *